US011342704B2

(12) United States Patent
Hsu

(10) Patent No.: US 11,342,704 B2
(45) Date of Patent: May 24, 2022

(54) SIGNAL CONNECTOR POSITIONING STRUCTURE AND SIGNAL LINE FABRICATION METHOD

(71) Applicant: Lih Yeu Seng Industries Co., Ltd., Yungkang (TW)

(72) Inventor: Chin-Teng Hsu, Yungkang (TW)

(73) Assignee: Lih Yeu Seng Industries Co., Ltd., Yungkang (TW)

( * ) Notice: Subject to any disclaimer, the term of this patent is extended or adjusted under 35 U.S.C. 154(b) by 52 days.

(21) Appl. No.: 16/669,606

(22) Filed: Oct. 31, 2019

(65) Prior Publication Data

US 2021/0135391 A1 May 6, 2021

(51) Int. Cl.

| | |
|---|---|
| ***H01R 13/504*** | (2006.01) |
| ***H01R 43/20*** | (2006.01) |
| ***H01R 13/512*** | (2006.01) |
| ***H01R 24/40*** | (2011.01) |
| *H01R 103/00* | (2006.01) |

(52) U.S. Cl.

CPC ..... *H01R 13/512* (2013.01); *H01R 13/504* (2013.01); *H01R 24/40* (2013.01); *H01R 43/20* (2013.01); *H01R 2103/00* (2013.01)

(58) Field of Classification Search

CPC ..... H01R 13/504; H01R 13/512; H01R 9/05–0527; H01R 24/40; H01R 43/20; H01R 2103/00; H01R 24/38–56; H01R 23/26

See application file for complete search history.

(56) References Cited

U.S. PATENT DOCUMENTS

| | | | | |
|---|---|---|---|---|
| 7,416,416 | B1 * | 8/2008 | Hsu | H01R 24/44 439/63 |
| 7,527,524 | B1 * | 5/2009 | Coleman | H01R 9/0521 439/578 |
| 8,100,704 | B1 * | 1/2012 | Wei | H01R 9/0512 439/97 |
| 10,770,832 | B2 * | 9/2020 | Franke | H02G 15/115 |
| 2005/0064761 | A1 * | 3/2005 | Stanford | H01R 13/005 439/577 |
| 2015/0024626 | A1 * | 1/2015 | Lu | H01R 9/0518 439/578 |

* cited by examiner

*Primary Examiner* — Edwin A. Leon
*Assistant Examiner* — Milagros Jeancharles
(74) *Attorney, Agent, or Firm* — Alan D. Kamrath; Karin L. Williams; Mayer & Williams PC

(57) ABSTRACT

A signal connector positioning structure comprises a connector, a connecting component, a conductive connecting component, and a insulating component; the connector has a first opening, a second opening, and a first fixing structure; the connecting component has a first connection port and a first fixing component; the conductive connecting component has an opening; the insulating component has an opening; the conductive connecting component penetrates through the insulating component; wherein, the first fixing structure and the first fixing component are removably fastened in a screwed manner.

4 Claims, 9 Drawing Sheets

SIGNAL CONNECTOR POSITIONING STRUCTURE AND SIGNAL LINE FABRICATION METHOD

BACKGROUND OF THE INVENTION

1. Technical Field

This application relates to a signal connector positioning structure, in particular to a signal connector positioning structure provided with a connecting component having an opening.

2. Description of Related Art

In the prior art, signal lines typically include coaxial cables and signal connectors (hereafter referred to as connectors), wherein the coaxial cables have a mesh-like metal braiding layer serving as a shielding layer against radiated emission (RE). The shielding layer needs to be torn during the process of signal line fabrication to expose the signal wire out of the coaxial cable, and in this case, the shielding layer will be in a rather messy state. In order to fix (store) the messy shielding layer in a connecting component, some manufacturers have proposed a way to fix the shielding layer onto the coaxial cable via a fixing assembly such as a metal ring.

However, this has led to other problems. Since the shielding layer itself is also a material capable of transmitting digital signals or analog signals, conducted emission (CE) interference will be caused in the case where both the shielding layer and the signal wire are fixed in the connecting component. Furthermore, since the shielding layer is not completely fixed, the signal line will swing or shake when disturbed by an external physical force, and the shielding layer that is not completely fixed will swing or shake at the same time, thus directly resulting in interference in the internal space of the signal connector.

Therefore, it is important to further reduce the interference caused by the isolation layer in the signal line fabrication technology.

BRIEF SUMMARY OF THE INVENTION

In order to solve the aforementioned problem of interference generated by the shielding layer in the connecting component, this application provides a signal connector positioning structure provided with a connecting component having an opening, a signal connector positioning structure, and corresponding signal line fabrication methods.

The signal connector positioning structure comprises a connector, a connecting component, a conductive connecting component, and an insulating component; the connector has a first opening, a second opening, and a first fixing structure; the connecting component has a first connection port and a first fixing component; the conductive connecting component has an opening; the insulating component has an opening; the conductive connecting component penetrates through the insulating component; wherein, the first fixing structure and the first fixing component are removably fastened in a screwed manner.

In one embodiment, the conductive connecting component has a resisting component which abuts against a top opening.

In one embodiment, the first connection port and the first opening are circular, and the diameter of the first connection port is greater than that of the first opening.

In one embodiment, the conductive connecting component is in the shape of a stepped cylinder and has a first end and a second end, and the diameter of the second end is greater than that of the first end.

The signal connector positioning structure comprises a connector, a first connecting component, a second connecting component, a conductive connecting component, a first insulating component, and a cover; the connector has a first opening, a second opening, and a third opening, and comprises a first fixing structure, a second fixing structure, and a third fixing structure; the first connecting component has a first connection port, a first fixing component, and an opening, and the second connecting component has a second connection port and a second fixing component; the conductive connecting component has a resisting component and an electronic contact; the first insulating component has an opening, and the conductive connecting component penetrates through the first insulating component and abuts against a top opening; wherein, the first fixing structure and the first fixing component are removably fastened in a screwed manner, the second fixing structure and the second fixing component are removably fastened in a screwed manner, and the cover is fastened on the third fixing structure.

In one embodiment, the cover has a notch.

In one embodiment, the cover is recessed towards the second fixing structure to form a recess component, and a shear surface is formed by the cover along the notch.

In one embodiment, the signal connector positioning structure further has a filler placed in the recess component.

In one embodiment, the signal connector positioning structure further comprises a second insulating component, and the electronic contact is located between the first insulating component and the second insulating component.

In light of the fact that two contact positioning structures of different forms are provided based on the same spirit of invention in this case, a signal line fabrication method based on the signal connector positioning structures in this application is further described below.

The signal line fabrication method in this application comprises: preparing the signal connector positioning structure and a coaxial cable, wherein the coaxial signal comprises, from inside to outside, a signal wire, a first insulating layer, a mesh-like conductive layer, and a second insulation layer; enabling the coaxial cable to penetrate through the first opening, so that the signal wire and the first insulating layer penetrate through the inside of the connector, the mesh-like conductive layer and the second insulating layer are located outside the connector, and the mesh-like conductive is located between the second insulating layer and the connector; fastening the connecting component to the connector in a screwed manner via the first fixing component and the first fixing structure; and welding the first fixing structure to the first fixing component at the opening.

In one embodiment, the signal line fabrication method further comprises: stamping the connecting component from the side, away from the coaxial cable, of the connecting component, and placing the connecting component in close contact with the mesh-like conductive layer.

In one embodiment, the signal line fabric method further comprises: installing a waterproof layer on the connector, the connecting component, and the second insulating layer.

A signal line fabrication method in this application comprises: preparing the signal connector positioning structure and a coaxial cable, wherein the coaxial cable comprises, from inside to outside, a signal wire, a first insulating layer, a mesh-like conductive layer, and a second insulating layer;

enabling the coaxial cable to penetrates through the first opening, so that the signal wire and the first insulating layer penetrate through the inside of the connector, the mesh-like conductive layer and the second insulating layer are located outside the connector, and the mesh-like conductive layer is located between the second insulating layer and the connector; placing the signal line in contact with the electronic contact; fastening the first connecting component to the connector in a screwed manner via the first fixing component and the first fixing structure; and welding the first fixing structure to the first fixing component.

In one embodiment, the signal line fabrication method further comprises: stamping the first connecting component from the side, away from the coaxial cable, of the connecting component, and placing the first connecting component in close contact with the mesh-like conductive layer.

In one embodiment, the signal line fabrication method further comprises: installing a waterproof layer on the connector, the connecting component, and the second insulating layer.

In summary, the spirit of this invention lies in that openings are formed in the connecting component (or the first connecting component) such that the connector can be further welded to the connecting component (or the connector can be welded to the first connecting component) after being fastened in a screwed manner.

In addition, by means of external stamping on the connecting component in this application, the connecting component can fix the shielding layer to the outside of the connector (or connector) to isolate the shielding layer from the signal wire, so that the shielding layer will not swing or shake under the influence of an external physical force, thus effectively reducing interference.

In addition, with regard to the signal connector positioning structure, a notch is designed on the cover and a filler is installed in the recess component in this application. The design of the notch prevents the cover from expansionary deformation caused by temperature changes. On the other hand, the filler can expand to different degrees according to temperature changes, thus solving the problems of external interference caused by failure to tightly fit the cover or the notch of the cover with the connector and the damage or wastage of the signal wire in the connector positioning structure caused by moisture or substances from outside.

DETAILED DESCRIPTION OF THE INVENTION

The signal connector positioning structure and the signal line fabrication method in preferred embodiments of the present invention are described below with reference to the related drawings, wherein identical components will be indicated by identical reference signs.

It should be noted that all directional indications (such as up, down, left, right, front, back . . . ) in each embodiment of this application are only used for explaining the relative positional relationships and motions of components at a certain attitude (for example, as shown in the figures). If the specific attitude changes, the directional indications will change accordingly.

First of all, a signal connector positioning structure and the fabrication method of a coaxial cable fixed with the signal connector positioning structure, and another signal connector positioning structure and the fabrication method of the coaxial cable fixed with the signal connector positioning structure will be disclosed in sequence. A two-way connector and a three-way connector (hereinafter referred to as connectors) are applied to a signal line, which may be any signal line with a shielding layer, such as an analog signal line, a digital signal line, a coaxial cable, or a non-coaxial cable, and this application has no limitation in this aspect. For the save of a convenient description, only the connector applied to the coaxial cable is illustrated below as an example.

Figure 1:
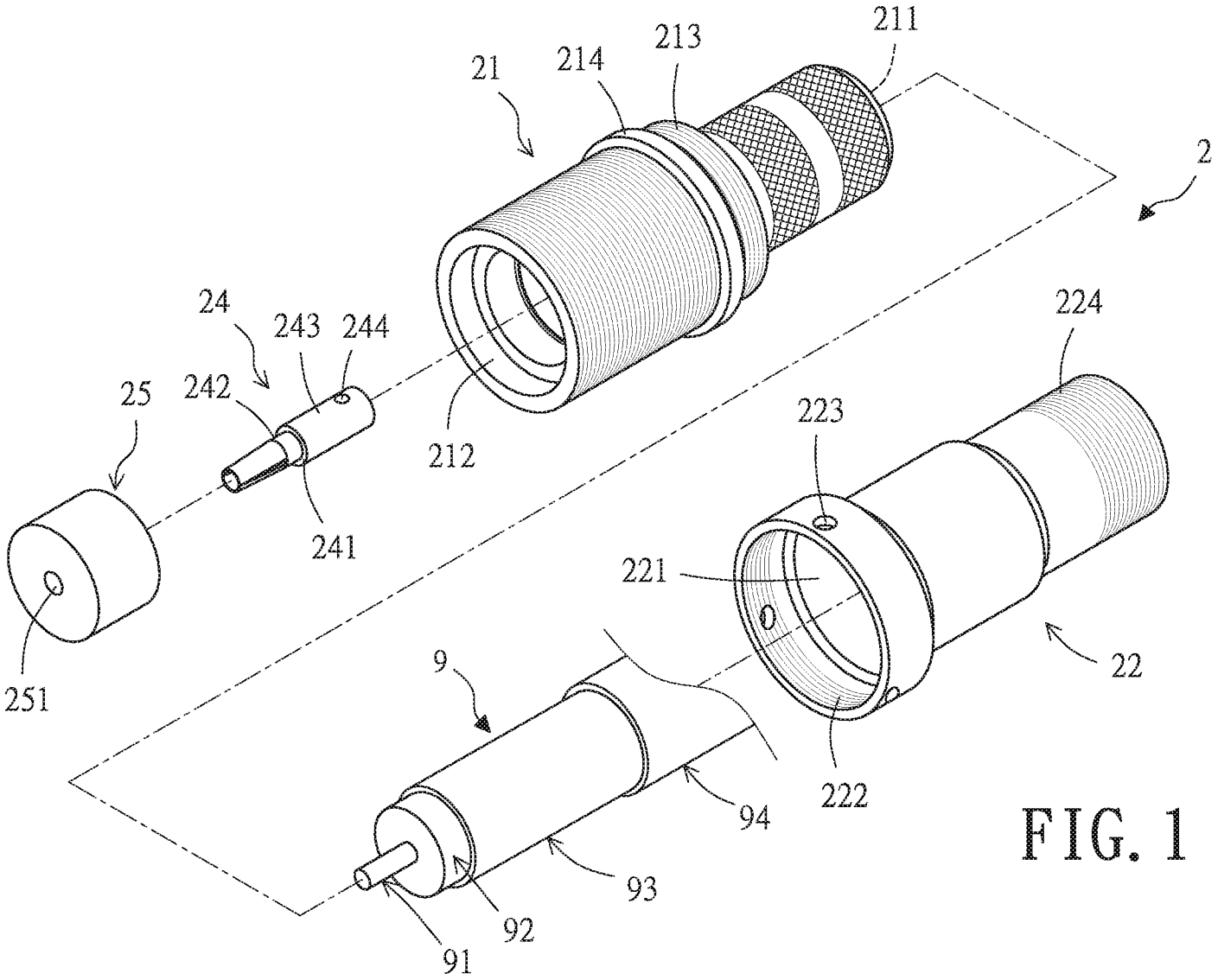
FIG. 1 is an exploded view of a signal connector positioning structure and a coaxial cable in one embodiment of this application.

As shown in FIG. 1, the signal connector positioning structure 2 in this application comprises a connector 21, a connecting component 22, a conductive connecting component 24, and an insulating component 25.

In this embodiment, the connector 21 is in the shape of a hollow cylinder so that a signal wire 91 can pass through the hollow part of the connector 21, and the connector 21 is a conductor (including, but not limited to, a metal material such as gold, silver and copper, a metal alloy, or a non-metal material such as a graphene tube and a nano-carbon tube, or a metal or non-metal alloy).

The connector 21 has a first opening 211, a second opening 212, and a first fixing structure 213. A thread is arranged on the outer surface of the side, close to the second opening 212, of the connector 21. A protruding component 214 is arranged in the middle of the thread. The first fixing structure 213 is located on the side near the first opening 211 with respect to the protruding component 214.

In this embodiment, the connecting component 22 has a first connection port 221, a first fixing component 222, and an opening 223. The first fixing component 222 is arranged on the inner edge of the first connection port 221, the first opening 211, the second opening 212, and the first connection port 221 are all circular, and the inner diameter of the first connection port 221 is greater than the outer diameter of the first opening 211, so that the connecting component 22 can be fastened to the first fixing structure 213 on the outer surface of the connector 21 in a screwed manner via the first fixing component 222 of the inner edge.

In addition, structures (such as, but not limited to, threads, multiple ring concave/convex structures 224, or mesh patterns) used for increasing the frictional force or fixing are arranged at the end, away from the first connection port 221, of the connecting component 22, so that a better adhesion effect is fulfilled when the outside of the connector 22 is wrapped with waterproof tape or coated with other coatings (such as, but not limited to, waterproof layers and heat-dissipation layers).

In particular, the connecting component 22 in this application has a connecting component opening 223 which is used for the purpose of welding the connector 21 to the connecting component 22, and a detailed description will be given below.

In this embodiment, the conductive connecting component 24 is in the shape of a stepped cylinder and has a first end 242 and a second end 243, wherein the diameter of the second end 243 is greater than that of the first end 242.

In this embodiment, the insulating component 25 is has an opening, and the conductive connecting component 24 penetrates through the insulating component 25; and the first fixing structure 213 is removably fastened to the first fixing component 222 in a screwed manner.

In one embodiment, the conductive connecting component 24 has a resisting component 241. The connective connecting 24 penetrates through the insulating component 25, and the resisting component 241 abuts against a top opening 251.

In one embodiment, the conductive connecting component 24 has a through hole 244 which is for the purpose of welding the signal line to the conductive connecting component 24. A detailed description will be given below.

Figure 2:
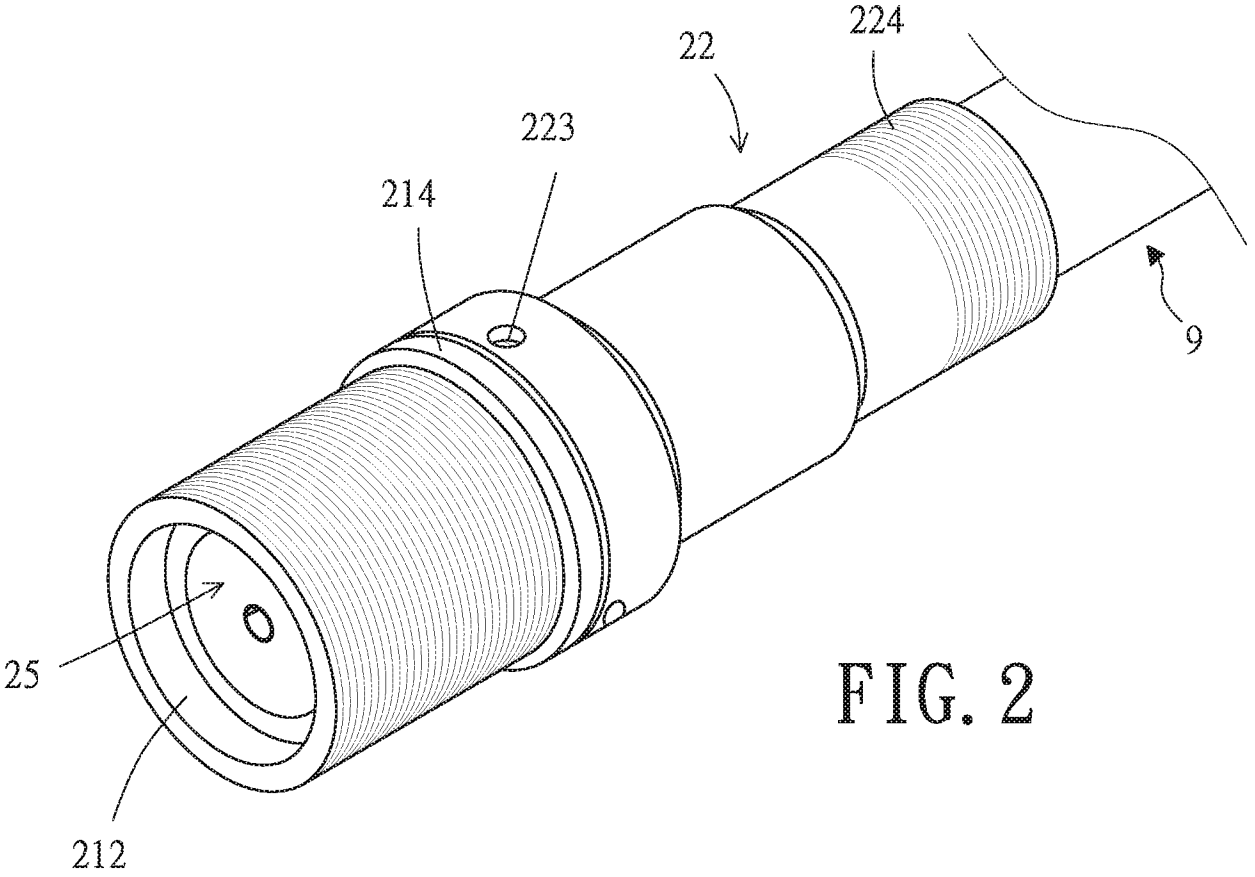
FIG. 2 is a schematic diagram of the coaxial cable adopting the signal connector positioning structure in one embodiment of this application.
Figure 3:
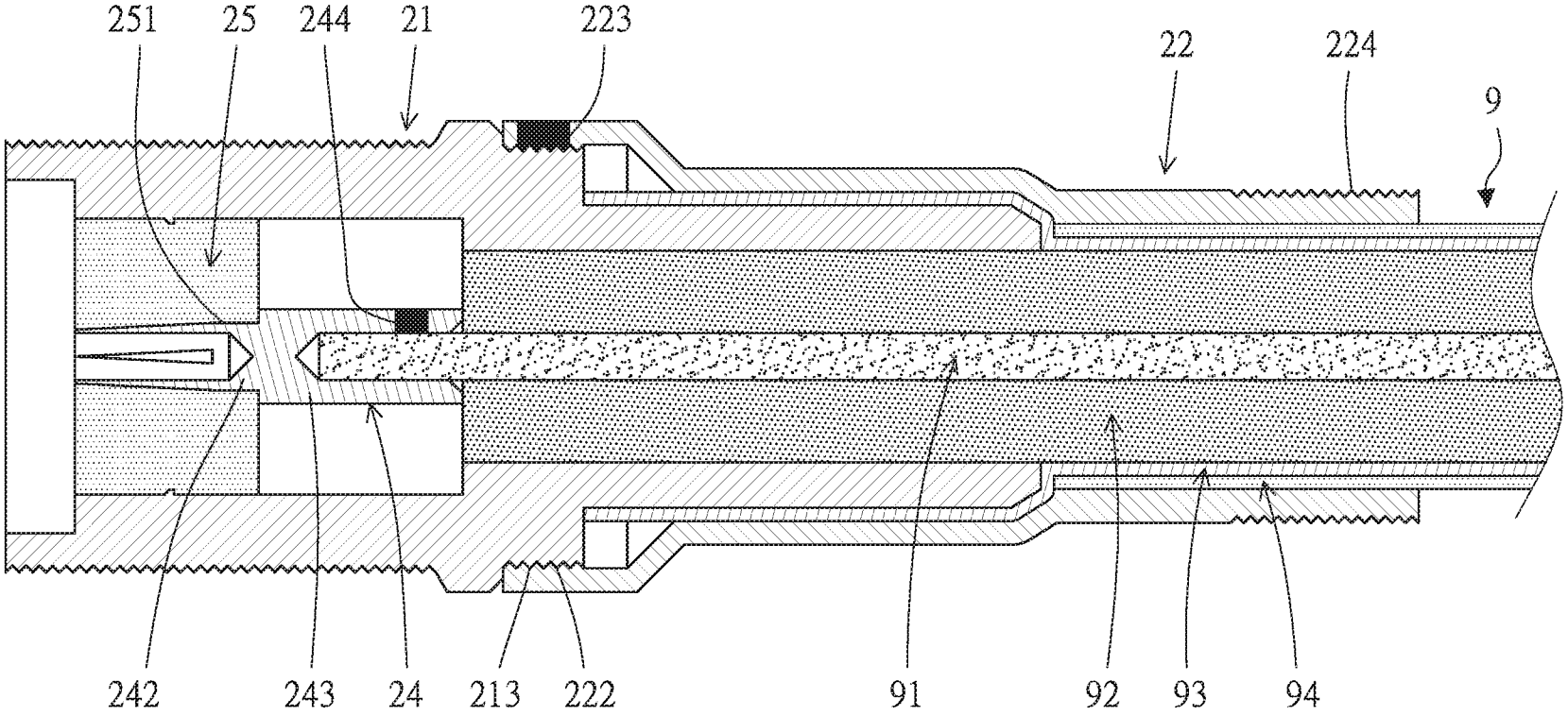
FIG. 3 is a sectional view of FIG. 2 (including welding)

As shown in FIG. 2 and FIG. 3, this application also discloses a fabrication method of a coaxial cable 9 which is fixed with the signal connector positioning structure 2. The method comprises the following steps: the connector 21 positioning structure and a coaxial cable 9 are prepared, wherein the coaxial cable 9 comprises, from inside to outside, a signal wire 91, a first insulating layer 92, a mesh-like conductive layer 93, and a second insulating layer 94, the signal wire 91 is made of a material selected from a group consisting of metal, metal-metal alloy, metal and non-metal alloy, graphene, and carbon nano-tubes; the coaxial cable 9 to penetrates through the first opening 211, the signal wire 91 and the first insulating layer 92 penetrate through the inside of the connector 21, the mesh-like conductive layer 93 and the second insulating layer 94 are located outside the connector 21, and the mesh-like conductive layer 9393 is located between the second insulating layer 94 and the connector 21; and the connecting component 22 is fastened to the connector 21 in a screwed manner via the first fixing component 222 and the first fixing structure 213.

Figure 4:
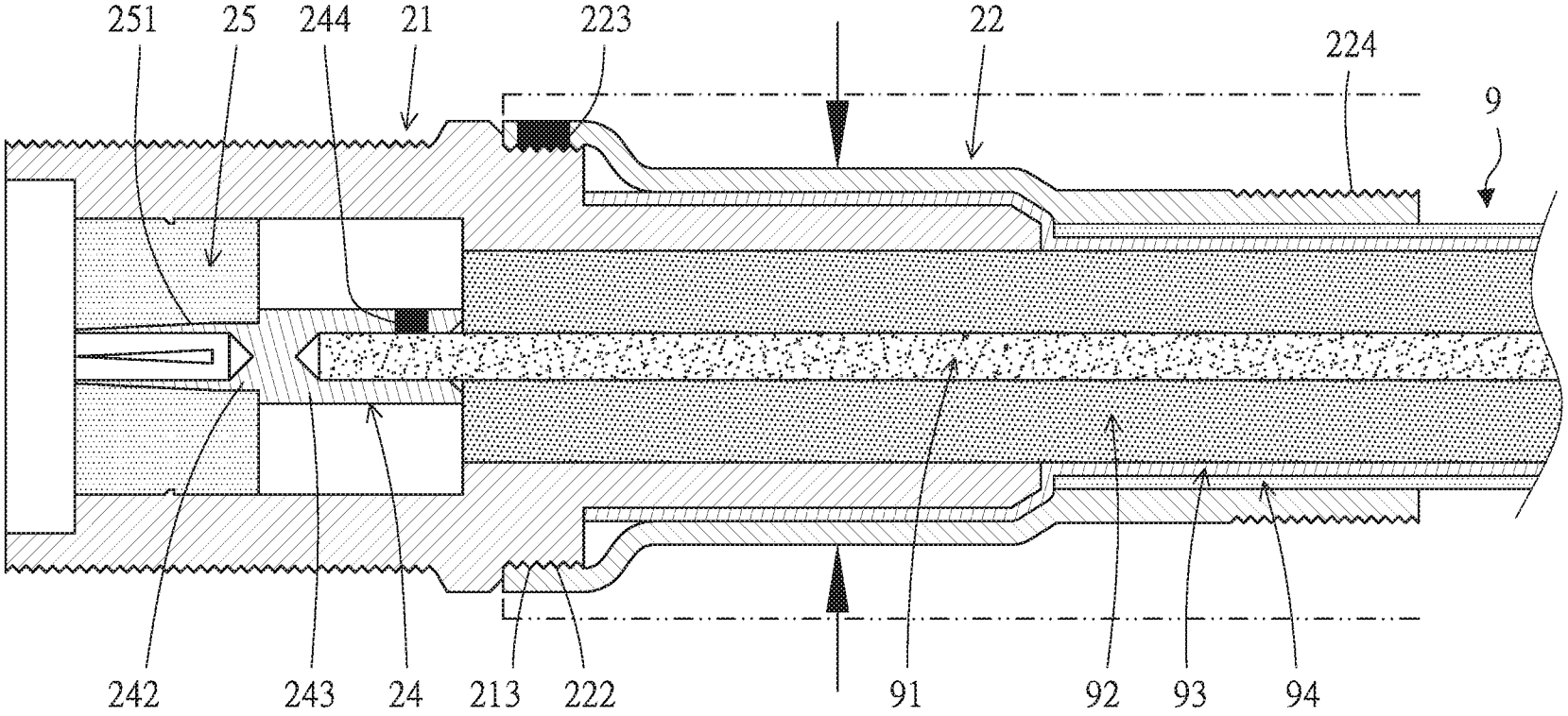
FIG. 4 is a schematic diagram of the stamping position and the position of a waterproof layer shown in FIG. 3.

As shown in FIG. 4, the fabrication method of the coaxial cable 9 fixed with the signal connector positioning structure 2 can also further comprise other steps, such as: the first fixing structure 213 is welded to the first fixing component 222 at the opening 223. Since the opening 223 is reserved in the signal connector positioning structure 2, the first fixing structure 213 and the first fixing component 222 of the signal connector positioning structure 2 in this application can be further welded after being fastened in a screwed manner. In addition, at certain specific sites (such as, but not limited to, power poles or communication towers) which are far away from a power supply or too narrow for welding, glue (such as, but not limited to, waterproof glue and super glue) can be injected via the opening 223.

In this embodiment, the fabrication method further comprises the step of stamping (also known as punching) (such as, but not limited to, cutting, bending, forming and extension) the connecting component 22 from the side, away from the coaxial cable 9, of the connector 22 (as indicated by the arrow in the figure). The connecting component 22 is in close contact with the mesh-like conductive layer 93.

In one embodiment, the stamping is used for machining the connecting component 22 into a hollow polygonal (such as, but not limited to, tetragonal, pentagonal, hexagonal, heptagonal, octagonal, or the like) prism. Broadly speaking, the connecting component 22 can be a tetragon, a pentagon, a hexagon, a heptagon, an octagon, or other polygons perpendicular to the cross section of connecting component 22 (the normal vector is parallel to the axial plane). It is characterized in that the connecting component 22 is machined into the polygonal prism, so that the connecting component 22 is made in even closer contact with the mesh-like conductive layer 93 more effectively.

In this embodiment, the fabrication method further comprises the step of winding waterproof tape outside the connecting component 22 or coating the connecting component 22 with other coatings (such as, but not limited to, the area covered by the line defined by two points in the figure). By means of structure (such as, but not limited to, threads, multiple ring concave/convex structures 224, or mesh-like patterns) used for increasing the frictional force or fixing and arranged at the end, away from the first connection port 221, of the connecting component 22, the waterproof tape has a better adhesion effect on the connecting component 22.

Figure 5:
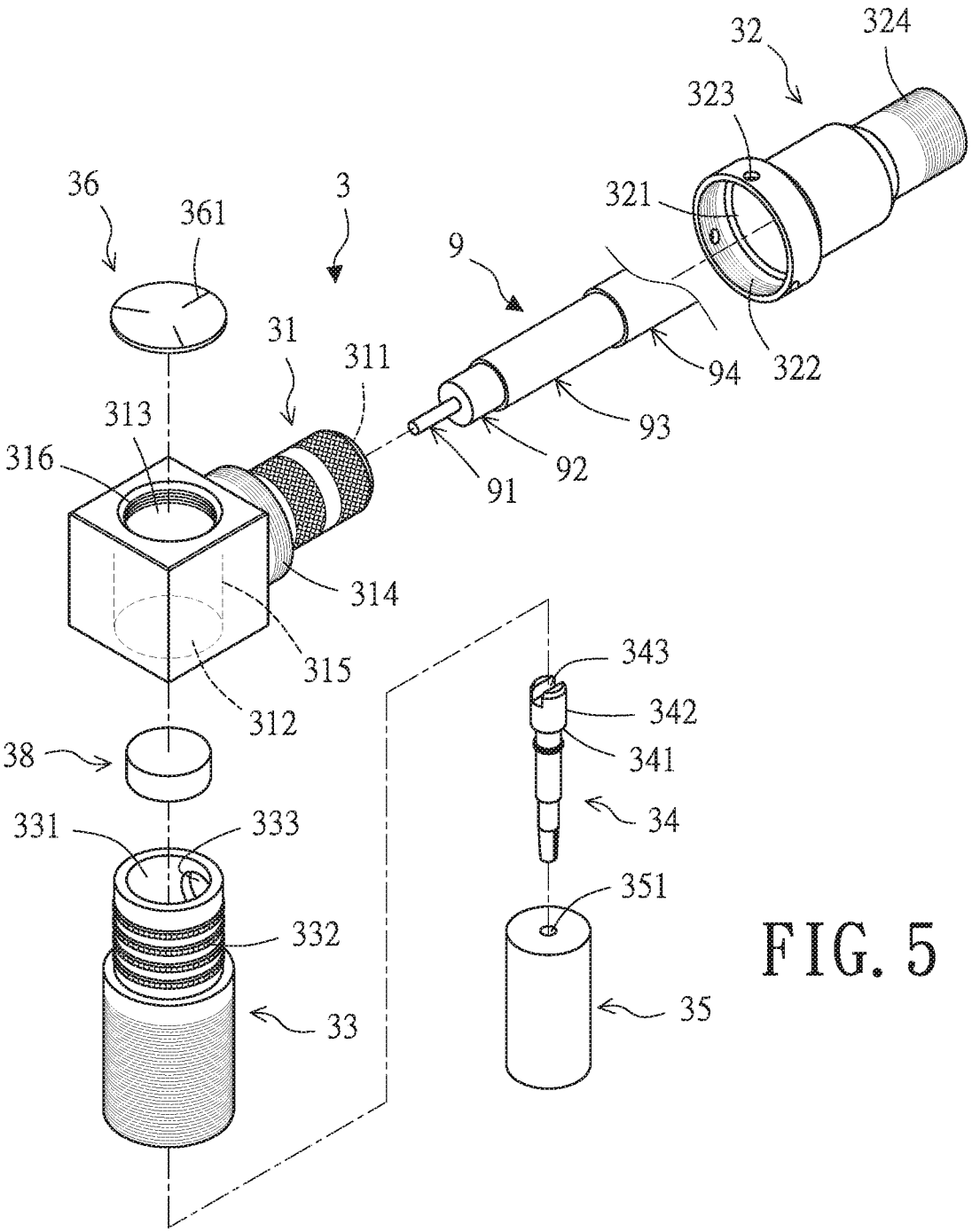
FIG. 5 is an exploded view of the signal connector positioning structure and the coaxial cable in one embodiment of this application.

As shown in FIG. 5, a connector 31 positioning structure 3 comprises: a connector 31, a first connecting component 32, a second connecting component 33, a conductive connecting component 34, a first insulating component 35, and a cover 36.

In this embodiment, the connector 31 is of a hollow cylindrical structure, so that a signal wire 91 can pass through though the hollow part of the connector 31. The through connector is a conductor (including, but not limited to, metal such as gold, silver and copper, a metal alloy, a non-metal material such as a graphene tube and a carbon nano-tube, or a metal and non-metal alloy).

The connector 31 has a first opening 311, a second opening 312, a third opening 313, a first fixing structure 314, a second fixing structure 315, and a third fixing structure 316.

In this embodiment, the first connecting component 32 has a first connection port 321, a first fixing component 322, and an opening 323. The first fixing component 322 is arranged on the inner edge of the first connection port 321. The first opening 311, the second opening 312, and the first connection port 321 are all circular, and the diameter of the first connection port 321 is greater than that of the first opening 311 and the second opening 312, so that the connecting component can be fastened to the first fixing structure 314 on the outer surface of the two-way connector via the first fixing component 322 on the inner edge in a screwed manner.

In addition, structures (such as, but not limited to, threads, multiple ring concave/convex structures 324 or mesh patterns) used for increasing the friction force or fixing are arranged at the end, far away from the first connection port 321, of the of the first connecting component 32, so that a better adhesion effect can be fulfilled when the connecting component is wrapped by waterproof tape or coated with other coatings (such as, but not limited to, waterproof layers and heat-dissipation layers).

In particular, the first connecting component 32 in this application has an opening 323 which is for the purpose of welding the three-way connector to the connecting component. A detailed description will be given below.

In this embodiment, the conductive connecting component 34 is in the shape of a stepped cylinder and has a first end 342 and a second end 343. The diameter of the second end 343 is greater than that of the first end 342.

In one embodiment, the conductive connecting component 34 has a resisting component 341 and an electronic contact 342. It should be noted that the configuration of the electronic contact 342 of the conductive connecting component 34 allows a signal in the axial direction of the first connecting component 32 to be redirected (by an angle such as, but not limited to, a from 5° to 175°, especially by an angle of 15°, 30°, 45°, 60°, 90°, 120°, 135°, or 165°) without bending a signal wire 91.

It is worth mentioning that the connector 31 positioning structure in this embodiment is further comprises a second connecting component 33. The second connecting component 33 has a second connection port 331 and a second fixing component 332. The second fixing component 332 is located on the outer surface of the second connection port 331, and the inner diameter of the second opening 312 is greater than the outer diameter of the second connection port 331, so that the second connecting component 33 can be fastened to the first fixing structure 314 on the inner surface of the second opening 312 of the two-way connector via the second fixing component 332 on the outer edge in a screwed manner. That is, the first fixing structure 314 can be removably fastened to the first fixing component 322 in a screwed manner, and the second fixing structure 315 can be removably fastened to the second fixing component 332 in a screwed manner.

In one embodiment, the second connecting component 33 has a through hole 333, and the coaxial cable 9 can penetrate through the through hole 333 to be in contact with the electronic contact 342 of the conductive connecting component 34. The signal wire 91 abuts against a concave component 343 such that the signal can be transmitted from the coaxial cable 9 to the conductive connecting component 34. In addition, the configuration of the concave component 343 allows the signal wire 91 to be fixed at the concave component 343 and to be further welded to the concave component 343, thus stabilizing the signal.

In this embodiment, the first insulating component 35 has an opening 351, the conductive connecting component 34 penetrates through the first insulating component 35, and the resisting component 341 abuts against a top opening 351.

Figure 6:
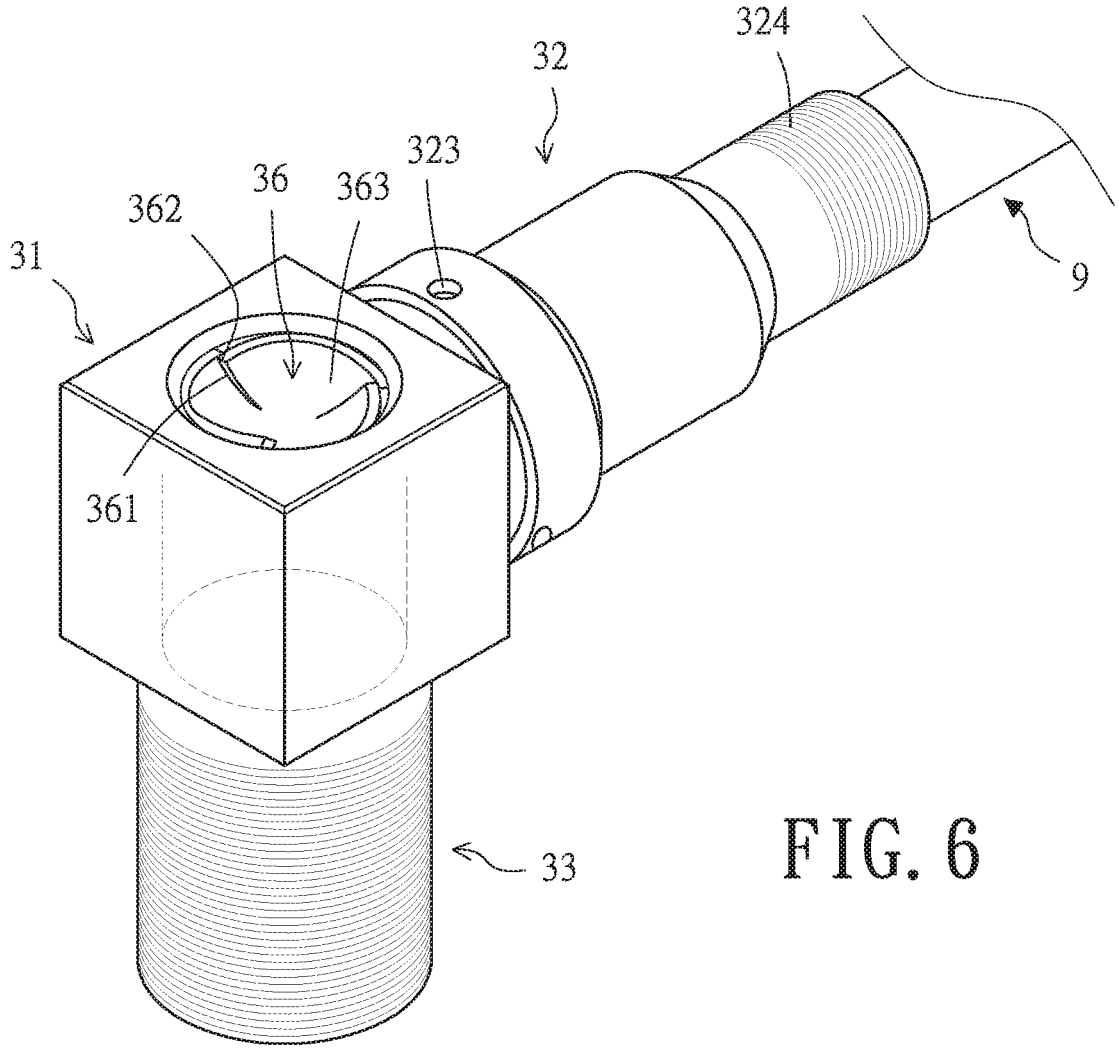
FIG. 6 is a schematic diagram of the coaxial cable adopting the signal connector positioning structure in one embodiment of this application.
Figure 7:
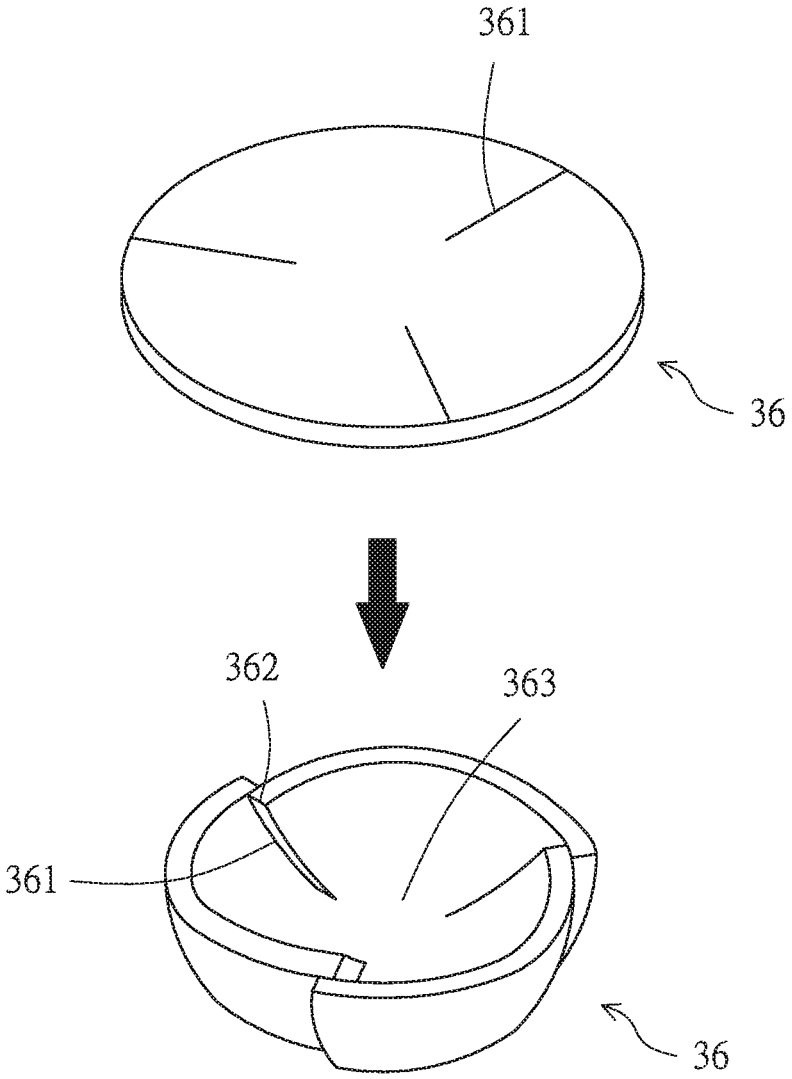
FIG. 7 is a schematic diagram of a recess component (and shearing surface) formed on a cover in one embodiment of this application.

As shown in FIG. 6 and FIG. 7, the cover 36 has a notch 361. When the cover 36 is fixed to the third fixing structure 316, the cover 36 is recessed towards the second fixing structure 315 to form a recess component 363, and a shear surface 362 is formed by the cover 36 along the notch 361. The cover 36 can be made of, but is not limited to, metal and metal or other materials with small specific heat, so there different degrees of expansion can be achieved by means of temperature changes, thus leading to the problem of distortion and deformation of the cover 36. The configuration of the notch 361 allows metal to expand in the shear direction of shear surface 362 when heated, thus solving the problem of distortion and deformation of the cover 36. In addition, the configuration of the notch 361 guarantees that the elastic recovery force (elasticity), opposite to the recess direction of the cover body 36 can be uniformly distributed (such as, but not limited to, 3 parts), so that in the process of installing the cover 36, the installation personnel can quickly and accurately fix the cover 36 to the third opening 313. Furthermore, if the shear surface 362 is formed by the notch 361, it indicates that the cover 36 is twisted to a certain degree, so there is also an elastic recovery force (torque) in the rotational direction, and the cover 36 fastened to the third fixing structure 361 more firmly by means of this torque.

Figure 8:
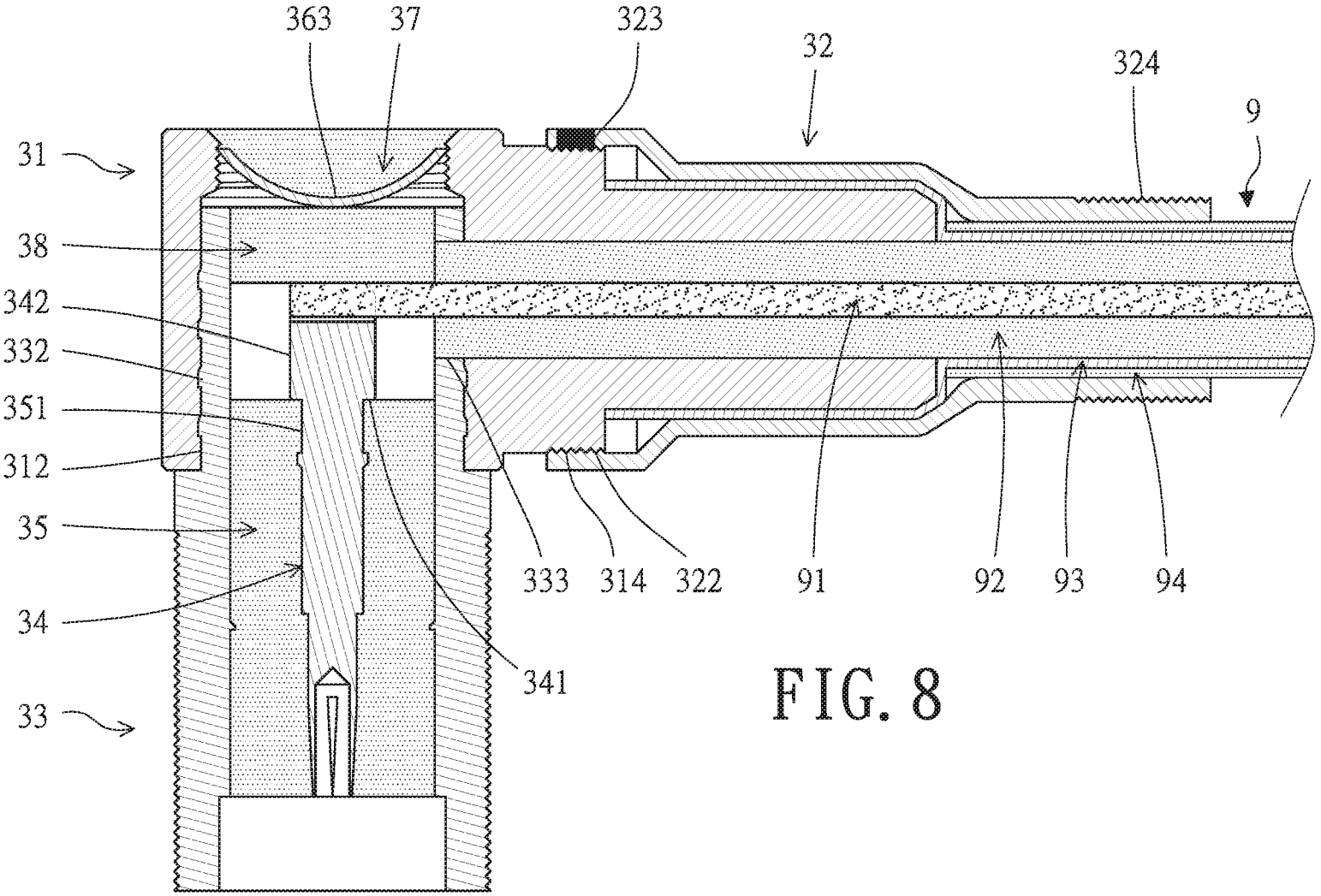
FIG. 8 is a sectional view of FIG. 6 (including filler and welding)

As shown in FIG. 8, the planar normal vector of the first connection port 321 is perpendicular to the planar normal vector of the second connection port 331, which means that the axial direction of the first connecting component 32 is perpendicular to the axial direction of the second connecting component 33.

In one embodiment, the connector 31 positioning structure 3 has a filler 37 used for filling the recess component 363.

In one embodiment, the connector 31 positioning structure 3 further comprises a second insulating component 38, and the electronic contact 342 is located between the first insulating component 35 and the second insulating component 38.

As shown in FIG. 8, this application also discloses a fabrication method of a coaxial cable 9 fixed with the connector 31 positioning structure 3. The method comprises the following steps: the an connector 31 positioning structure 3 and a coaxial cable 9 are prepared, wherein the coaxial cable 9 comprises, from inside to outside, a signal wire 91, a first insulating layer 92, a mesh-like conductive layer 93, and a second insulating layer 94, the signal wire 91 is made of a material selected from a group consisting of metal, metal alloy, metal and non-metal alloy, graphene, and carbon nano-tubes; the coaxial cable 9 penetrates through the first opening 331, such that the signal wire 91 and the first insulating layer 92 can penetrate through the inside of connector 31, the mesh-like conductive layer 93 and the second insulating layer 94 are located outside the connector 31, the mesh-like conductive layer 93 is located between the second insulating layer 94 and the connector 31, and the signal wire 91 is in contact with the electronic contact 342; and the first connecting component 32 is fastened to the connector 31 in a screwed manner via the first fixing component 322 and the first fixing structure 314.

Figure 9:
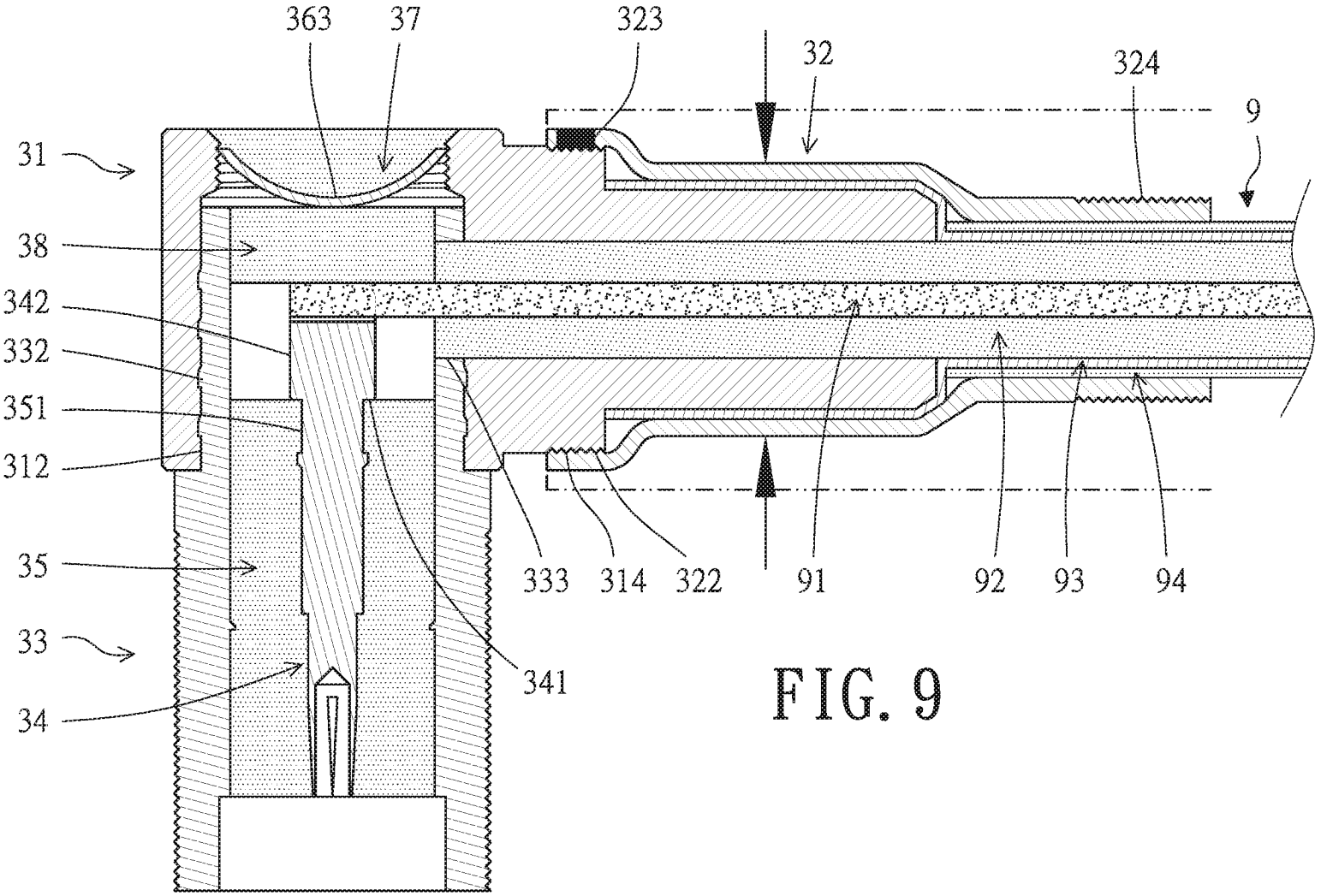
FIG. 9 is a schematic diagram of the stamping position and the position of the waterproof layer in FIG. 8.

As shown in FIG. 9, the fabrication method of the coaxial cable 9 fixed with the connector 31 positioning structure 3 further comprises the step of welding the first fixing structure and the first fixing component. Since an opening 323 is reserved in the signal connector positioning structure 3, the first fixing structure 314 and the first fixing component 322 of the signal connector positioning structure 3 of this application can be further welded after being fastened in a screwed manner.

In addition, at certain specific sites (such as, but not limited to, power poles or communication towers) which are far away from a power supply or too narrow for welding, glue (such as, but not limited to, waterproof glue and super glue) can be injected via the opening 323.

The first connecting component 32 is stamped from side, away from the coaxial cable 9, of the first connecting component 32, so as to be in close contact with the mesh-like conductive layer 93.

In one embodiment, the stamping is used for machining the connecting component 32 into a hollow polygonal (such as, but not limited to, tetragonal, pentagonal, hexagonal, heptagonal, octagonal, or the like) prism. Broadly speaking, the connecting component 32 can be a tetragon, a pentagon, a hexagon, a heptagon, an octagon, or other polygons perpendicular to the cross section of connecting component 32 (the normal vector is parallel to the axial plane). It is characterized in that the connecting component 32 is machined into the polygonal prism, so that the connecting component 32 is made in even closer contact with the mesh-like conductive layer 93 more effectively.

In this embodiment, the fabrication method further comprises the step of winding outside the connecting component or coating the connecting components with other coatings (such as, but not limited to, the area covered by the line defined by two points in the figure). By means of structures (such as, but not limited to, threads, multiple ring concave/convex structures 324, or mesh-like patterns) used for increasing the friction force or fixing and arranged at the end, away from the first connection port 321, of the connecting component 32, the waterproof tape has a better adhesion effect on the connecting component.

In summary, the spirit of invention of the application lies in that by means of an opening formed the connecting component (or the first connecting component), the two-way connector and the connecting component (or the three-way connector and the first connecting component) can be further welded after being fastened in a screwed manner.

In addition, by means of the external stamping of the connecting component, the connecting component can fix the shielding layer to the outside of the two-way connector (or the three-way connector) to isolate the shielding layer from the signal wire, thus effectively reducing interference.

In addition to the two-way connector, a filler is arranged in the recess component in this application. The filler can expand to different degrees according to temperature changes, thus solving the problems of interference caused by failure to tightly fit the cover with the three-way connector and the damage or wastage of the signal wire inside the three-way connector positioning structure caused by external moisture or substances.

It should be particularly pointed out that the only difference between the signal connector positioning structures is that whether a second connecting component or more connecting components are adopted to allow the signal wire to transmit signals in any other directions. Therefore, a four-way connector positioning structure, a five-way connector positioning structure, or connector positioning structures having more openings should also be included in the spirit of invention of this application.

The above embodiments are only illustrative and are not restrictive. Any equivalent modifications or changes achieved without deviating from the spirit of this application or going beyond the scope of this application should also fall within the scope defined by the appended claims.

What is claimed is:

1. A signal connector positioning structure comprising:

a connector having a first opening, a second opening, and a first fixing structure;

a connecting component having a first connection port and a first fixing component, wherein the first fixing component is arranged on an inner edge of the first connection port, wherein the first connection port and the first opening are circular and a diameter of the first connection port is greater than a diameter of the first opening of the connector, and wherein the connecting component has a circular connecting component opening through a wall of the first fixing component;

a conductive connecting component, having a circular opening through a wall of said conductive connecting component; and a resisting component; and an insulating component having an insulating component opening extending through the insulating component ending at a top opening at a top of the insulating component wherein the conductive connecting component penetrates through the insulating component opening and the resisting component abuts against the top opening of the insulting component, wherein the first fixing component is fastened to the first fixing structure in a screwed manner, and wherein the first fixing structure is welded to the first fixing component through the connecting component opening in the wall of the first fixing component.

2. A signal connector positioning structure, comprising:

a connector having a first opening, a second opening, a third opening, a first fixing structure, a second fixing structure, and a third fixing structure;

a first connecting component having a first connection port, a first fixing component, and a first connecting component circular opening through a wall of the first fixing component;

a second connecting component having a second connection port and a second fixing component;

a conductive connecting component having a resisting component and an electronic contact;

a first insulating component having a first insulating component opening, wherein the conductive connecting component penetrates through the first insulating component opening, and the resisting component abuts against a top of the first insulating component opening; and a cover having one or more notches and recessed toward the second fixing structure, wherein a shear surface is formed by the cover along each one or more notches, wherein, the first fixing structure is fastened to the first fixing component in a screwed manner, the second fixing structure is fastened to the second fixing component in a screwed manner, and the cover is fastened to the third fixing structure, and wherein the first connecting component is fixed to the connector by welding through the first connecting component circular opening in the wall of the first fixing component.

3. The signal connector positioning structure according to claim 2, wherein the cover is recessed towards the second fixing structure to form a recess component, and a shearing surface is formed by the cover along a notch.

4. The signal connector positioning structure according to claim 2, wherein the signal connector positioning structure has a filter injected into a recess component.

* * * * *